US008720348B2

(12) United States Patent
Roh

(10) Patent No.: US 8,720,348 B2
(45) Date of Patent: May 13, 2014

(54) BILATERAL ROTATION APPARATUS AND FURNITURE INCLUDING THE SAME

(71) Applicant: Koas Co., Ltd.

(72) Inventor: Jae Gyun Roh, Seoul (KR)

(73) Assignee: Koas Co., Ltd. (KR)

( * ) Notice: Subject to any disclaimer, the term of this patent is extended or adjusted under 35 U.S.C. 154(b) by 0 days.

(21) Appl. No.: 13/629,792

(22) Filed: Sep. 28, 2012

(65) Prior Publication Data

US 2013/0081559 A1 Apr. 4, 2013

(30) Foreign Application Priority Data

Sep. 29, 2011 (KR) ..... 10-2011-0098971

(51) Int. Cl.
*A47B 37/00* (2006.01)

(52) U.S. Cl.
USPC ..... 108/50.02

(58) Field of Classification Search
USPC ..... 108/50.01, 50.02, 23; 312/223.3, 223.6, 312/223.2, 223.1
See application file for complete search history.

(56) References Cited

U.S. PATENT DOCUMENTS

| | | | | |
|---|---|---|---|---|
| 4,433,630 | A * | 2/1984 | Laborie | 108/50.02 |
| 4,838,175 | A * | 6/1989 | Hauville | 108/25 |
| 5,231,562 | A * | 7/1993 | Pierce et al. | 108/50.02 |
| 5,237,935 | A * | 8/1993 | Newhouse et al. | 108/50.02 |
| 5,277,131 | A * | 1/1994 | Fortsch | 108/50.02 |
| 6,202,567 | B1 * | 3/2001 | Funk et al. | 108/50.02 |
| 6,338,301 | B1 * | 1/2002 | Almond | 108/50.02 |
| 6,435,106 | B2 * | 8/2002 | Funk et al. | 108/50.02 |
| 6,732,660 | B2 * | 5/2004 | Dame et al. | 108/50.01 |
| 6,732,661 | B2 * | 5/2004 | Grasse et al. | 108/50.02 |
| 6,766,748 | B2 * | 7/2004 | Insalaco et al. | 108/50.02 |
| 7,407,392 | B2 * | 8/2008 | Cooke et al. | 312/223.6 |
| 7,966,951 | B1 * | 6/2011 | Black et al. | 108/50.02 |

* cited by examiner

*Primary Examiner* — Jose V Chen
(74) *Attorney, Agent, or Firm* — Schmeiser, Olsen & Watts, LLP

(57) ABSTRACT

A bilateral rotation apparatus including a support member, a first connecting rod hingedly connected to one side of the support member in a longitudinal direction to be rotated along a locus of an arc, a second connecting rod hingedly connected to an opposite side of the support member in the longitudinal direction to be rotated along a locus of an arc, and connecting members disposed on an upper side of the support member is provided. The bilateral rotation apparatus is provided to a panel of furniture to open a wiring cap for wiring operation independently in one direction or in an opposite direction, thereby eliminating restriction on a wiring direction.

5 Claims, 9 Drawing Sheets

BILATERAL ROTATION APPARATUS AND FURNITURE INCLUDING THE SAME

BACKGROUND

1. Technical Field

The present invention relates to a bilateral rotation apparatus and furniture including the same. More particularly, the present invention relates to a bilateral rotation apparatus placed in a panel of furniture to open a wiring cap for wiring operation independently in one direction or in an opposite direction, thereby eliminating restriction on a wiring direction.

2. Description of the Related Art

With the distribution of office automation devices, various electronic devices such as computers, printers, telephones, facsimiles, and network devices are disposed around a desk of a home or an office.

Such various office devices receive electric power through cables, and various lines are coupled to each other to transmit data.

In particular, for recent computerized systems in an office, the number of lines connected to desks is gradually increasing due to computer network wires or phone wires.

When cables are located on a desk, they ruin the appearance of the office and cause inconvenience of workers.

Thus, operators generally arrange disordered cables using various means such as cable ties or tapes.

In order to solve such problems, cable boxes or desks configured to rearrange cables have been proposed.

A desk including a cable arranging apparatus is disclosed in Korean Utility Model Registration No. 20-0240901.

However, since an existing cable arranging apparatus for desks is configured to allow a cover of a cable arranging case to be open or closed only in one direction, there is a limit in a wiring direction or a direction of approaching the desk in use. Thus, there is a need to solve such problems in the related art.

BRIEF SUMMARY

The present invention has been conceived to solve such problems in the related art and an aspect of the present invention is to provide a bilateral rotation apparatus, which is placed in a panel of a table to allow a wiring cap for wiring operation to be open independently in one direction or in an opposite direction, thereby eliminating restriction on a wiring direction or a direction of approaching the table in use, and furniture including the same.

In accordance with one aspect of the present invention, a bilateral rotation apparatus includes: a support member; a first connecting rod hingedly connected to one side of the support member in a longitudinal direction to be rotated along a locus of an arc; a second connecting rod hingedly connected to an opposite side of the support member in the longitudinal direction to be rotated along a locus of an arc; and connecting members disposed on an upper side of the support member. Here, one of the connecting members is hingedly connected at one side thereof to the second connecting rod and the other connecting member is hinged connected to the other side of the first connecting rod in the longitudinal direction so as to be rotated independently in one direction or in an opposite direction.

The support member may include: a plate; and a support block detachably coupled to the plate and hingedly connecting the first connecting rod to the second connecting rod.

The plate may be provided at opposite sides thereof with insertion ribs bent in opposite directions such that the support block is slidably inserted into the insertion ribs.

In accordance with another aspect of the present invention, furniture includes: an installation hole formed in a panel; a frame inserted into the installation hole and open at upper and lower sides thereof; bilateral rotation apparatuses placed at opposite edges of the frame; and a cover connected at lower opposite sides thereof to the bilateral rotation apparatuses and rotated independently in one direction or in an opposite direction to prevent restriction on directionality of wiring operation.

Each of the bilateral rotation apparatuses may include: a support member connected to a lower side of the frame; a first connecting rod hingedly connected to one side of the support member in a longitudinal direction to be rotated along a locus of an arc; a second connecting rod hingedly connected to an opposite side of the support member in the longitudinal direction to be rotated along a locus of an arc; and connecting members disposed on an upper side of the support member. Here, one of the connecting members is hingedly connected at one side thereof to the second connecting rod and the other connecting member is hinged connected to the other side of the first connecting rod in the longitudinal direction so as to be rotated independently in one direction or in an opposite direction. The connecting members are connected to the cover.

The cover may be formed with an insertion groove and each of the connecting members may be formed with an insertion boss to be inserted into the corresponding insertion groove.

The insertion groove may be formed at one side thereof or at either sides thereof with a guide rib, and the insertion boss may be formed with a resilient guide groove into which the guide rib is resiliently inserted.

The cover may have a smaller area than a planar area of an opened portion of the frame such that wiring operation is performed in a closed state of the cover, and the frame may include a flexible brush member to maintain a wired state.

The panel may include legs extending therefrom, and each of the legs may include a detachable holder for inserting and arranging the wired cable in the leg.

BRIEF DESCRIPTION OF THE DRAWINGS

The above and other aspects, features and advantages of the present invention will become apparent from the following description of embodiments given in conjunction with the accompanying drawings, in which.

DETAILED DESCRIPTION

Embodiments of the present invention will now be described in detail with reference to the accompanying drawings. It should be noted that the drawings are not to precise scale and may be exaggerated in thickness of lines or size of components for descriptive convenience and clarity only. Furthermore, the terms used herein are defined by taking functions of the present disclosure into account and can be changed according to user or operator's custom or intention. Therefore, definition of the terms should be made according to the overall disclosure set forth herein.

Figure 1:
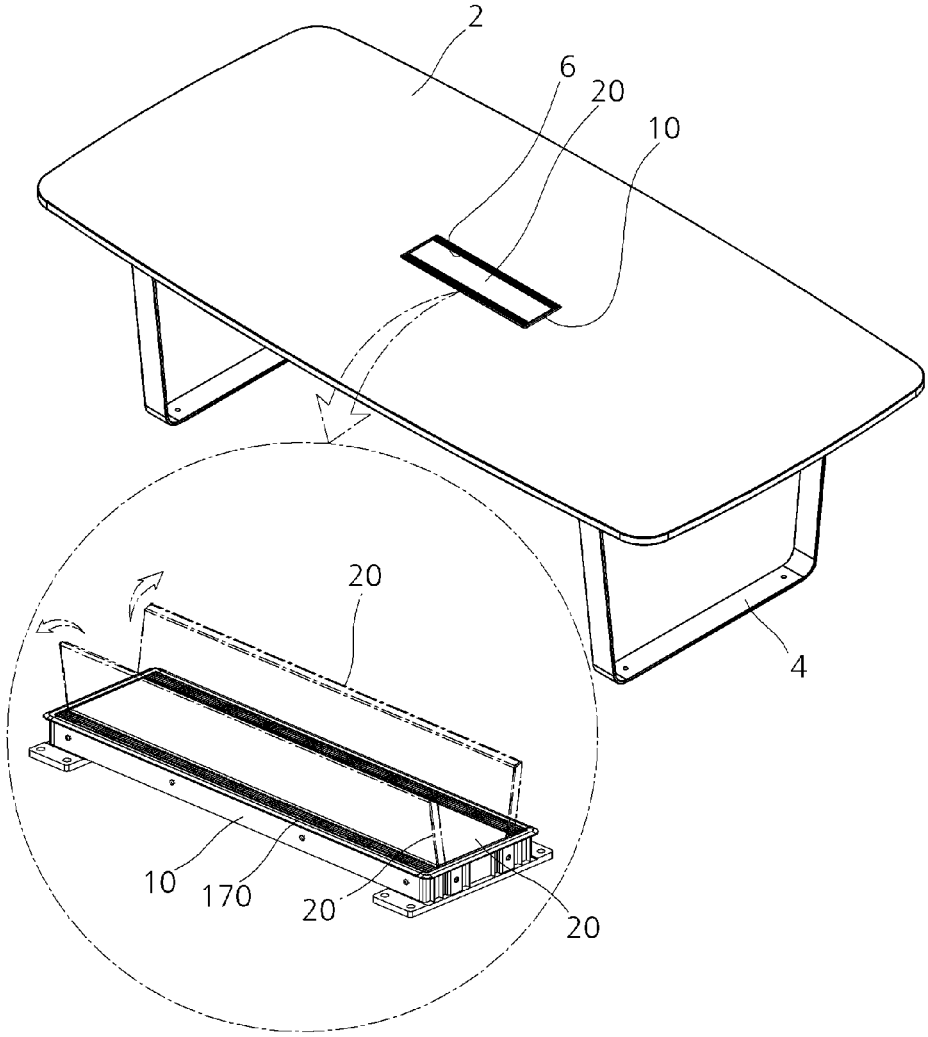
FIG. 1 is a perspective view of furniture including a bilateral rotation apparatus according to one embodiment of the present invention.
Figure 2:
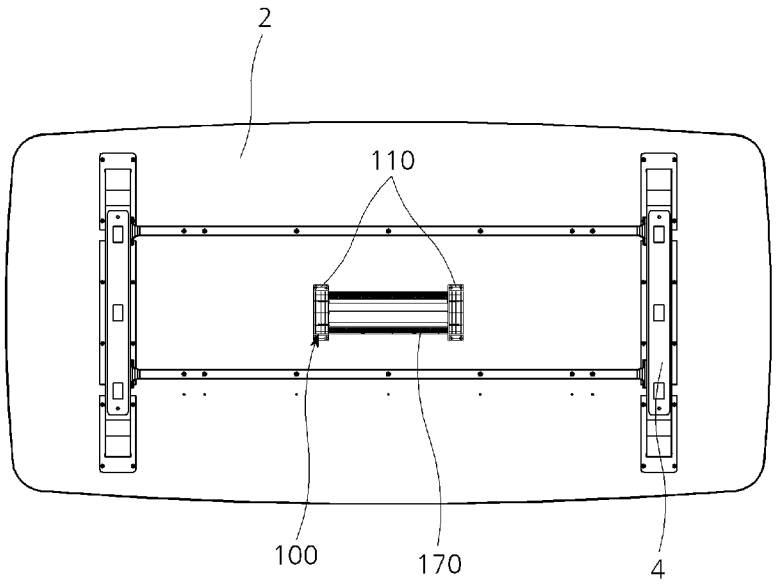
FIG. 2 is a bottom view of the furniture including the bilateral rotation apparatus according to the embodiment of the present invention.

FIG. 1 is a perspective view of furniture including a bilateral rotation apparatus according to one embodiment of the present invention, and FIG. 2 is a bottom view of the furniture including the bilateral rotation apparatus according to the embodiment of the present invention.

Figure 3:
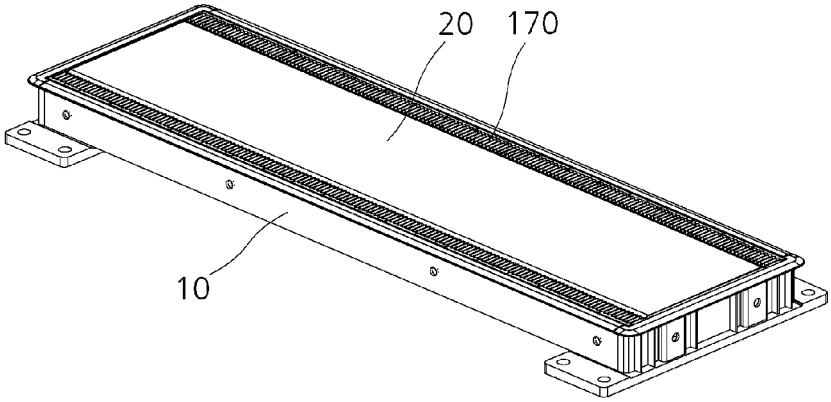
FIG. 3 is a perspective view of the bilateral rotation apparatus according to the embodiment of the present invention.
Figure 4:
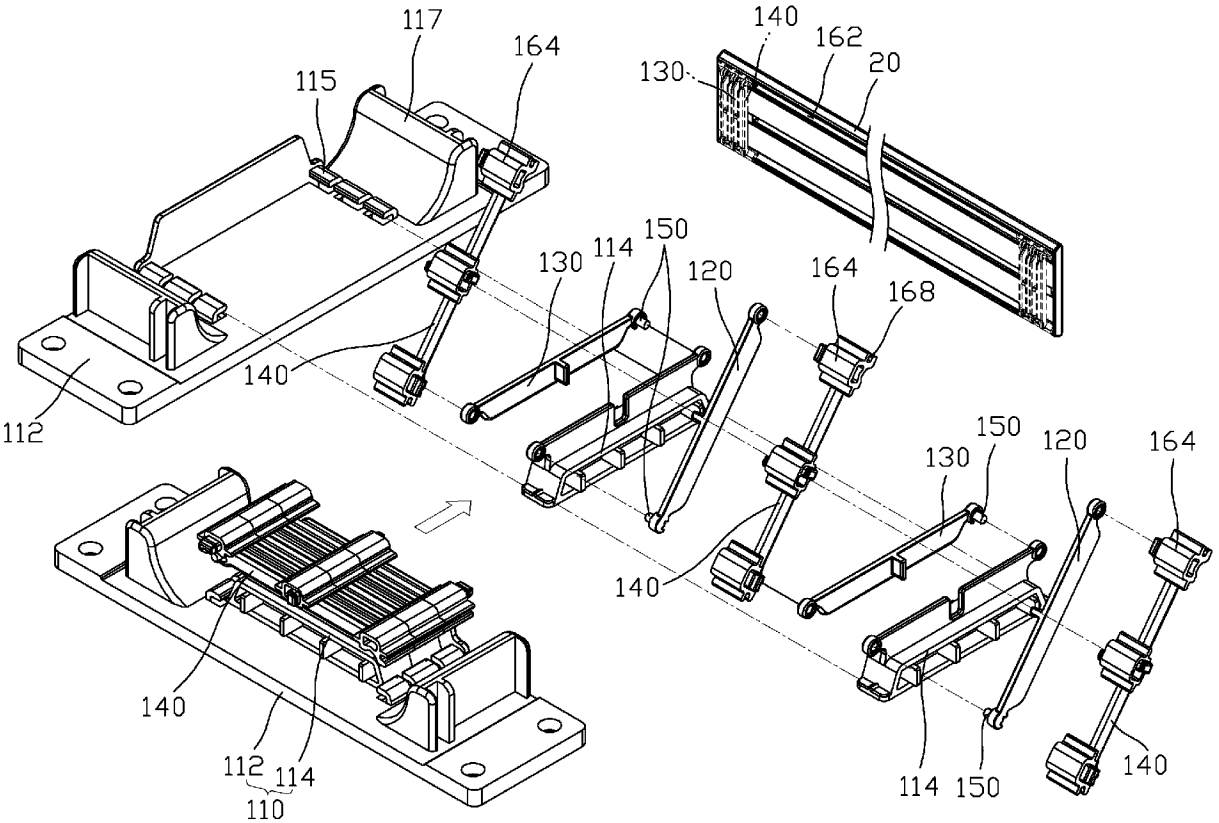
FIG. 4 is an exploded perspective view of the bilateral rotation apparatus according to the embodiment of the present invention.

FIG. 3 is a perspective view of the bilateral rotation apparatus according to the embodiment of the present invention, and FIG. 4 is an exploded perspective view of the bilateral rotation apparatus according to the embodiment of the present invention.

Figure 5:
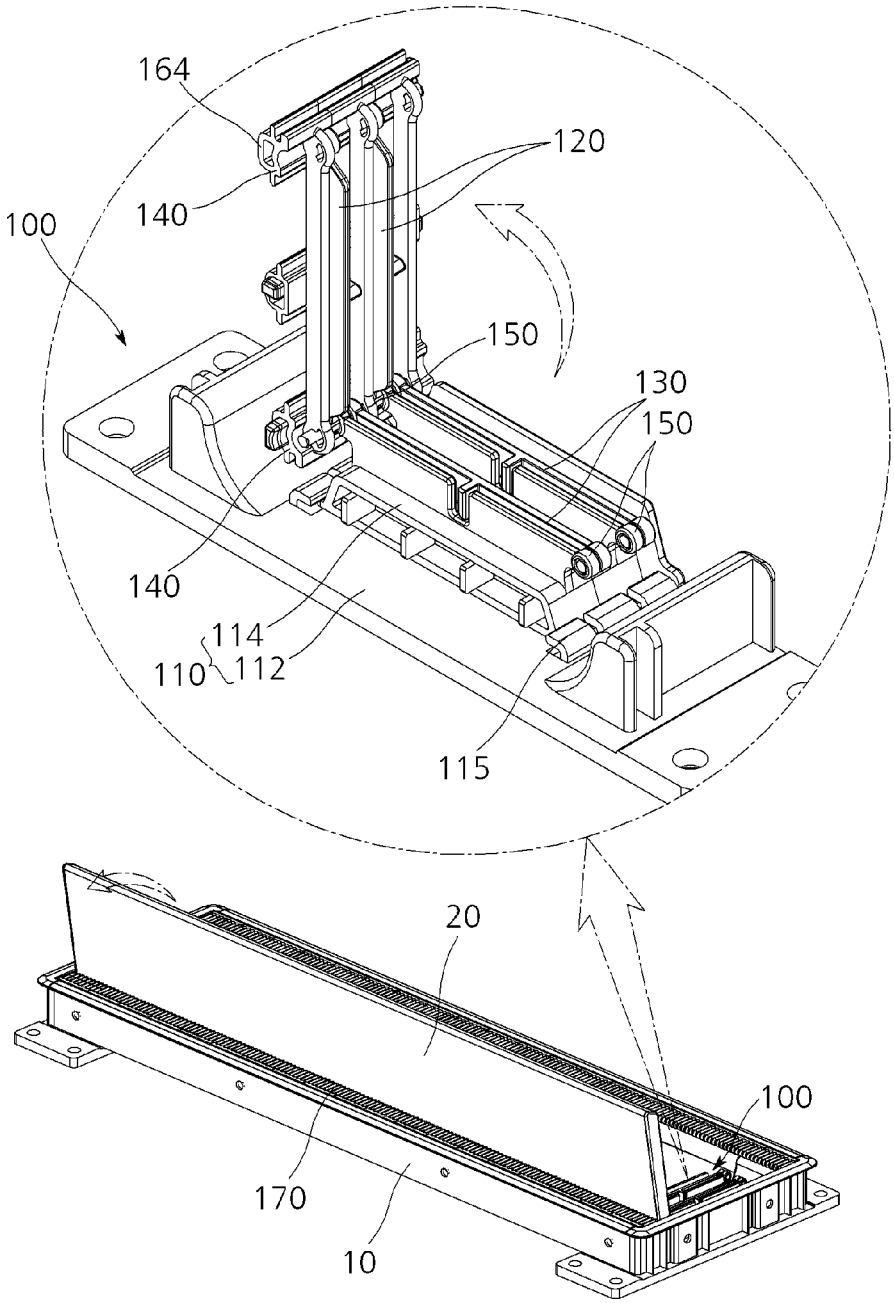
FIG. 5 is a perspective view of the bilateral rotation apparatus, which is open at one side thereof, according to the embodiment of the present invention.
Figure 6:
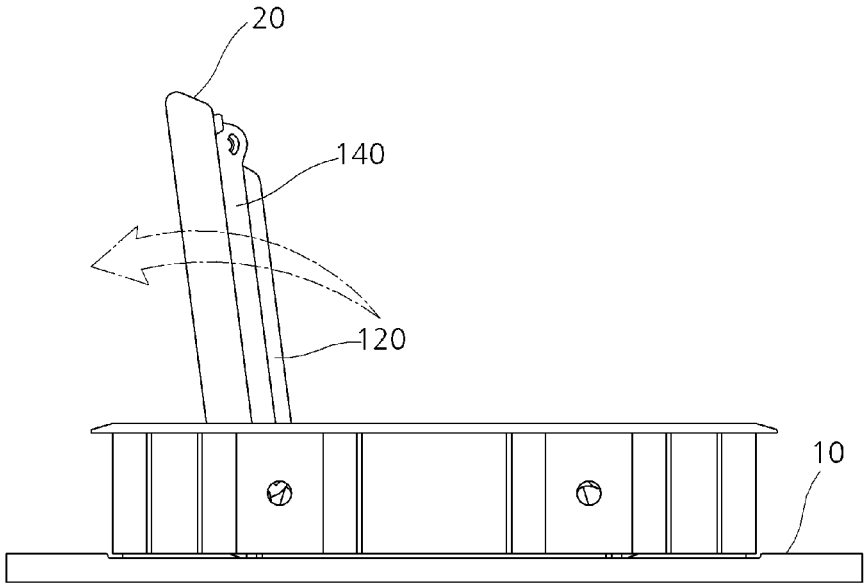
FIG. 6 is a side view of FIG. 5.
Figure 7:
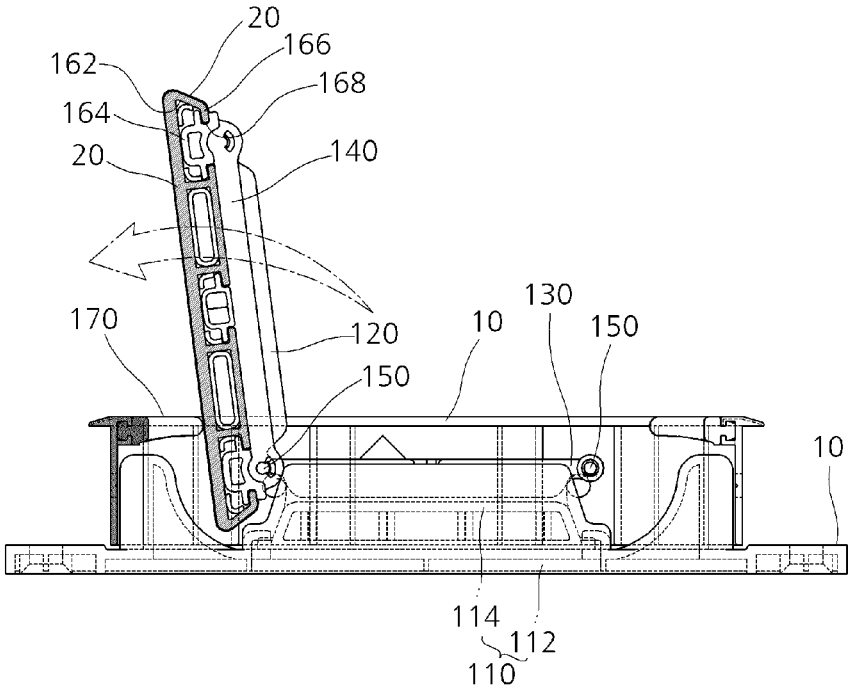
FIG. 7 is a sectional view of FIG. 5.

FIG. 5 is a perspective view of the bilateral rotation apparatus, which is open at one side thereof, according to the embodiment of the present invention, FIG. 6 is a side view of FIG. 5, and FIG. 7 is a sectional view of FIG. 5.

Figure 8:
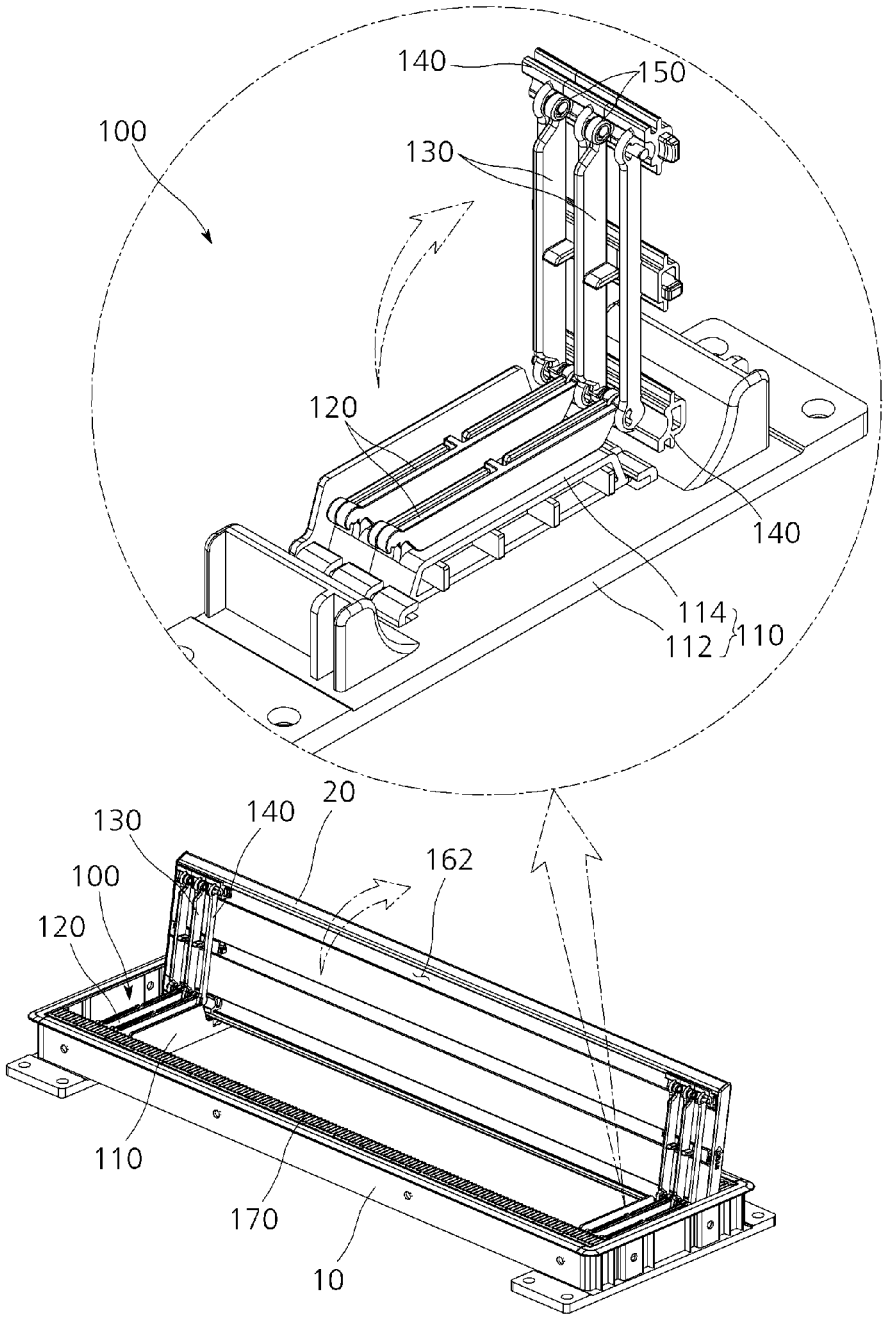
FIG. 8 is a perspective view of the bilateral rotation apparatus, which is open at the other side thereof, according to the embodiment of the present invention.
Figure 9:
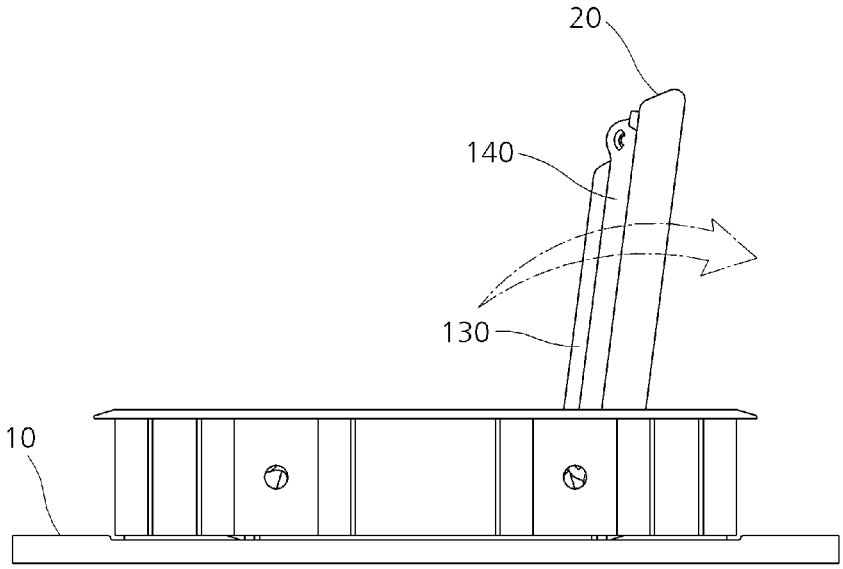
FIG. 9 is a side view of FIG. 8.
Figure 10:
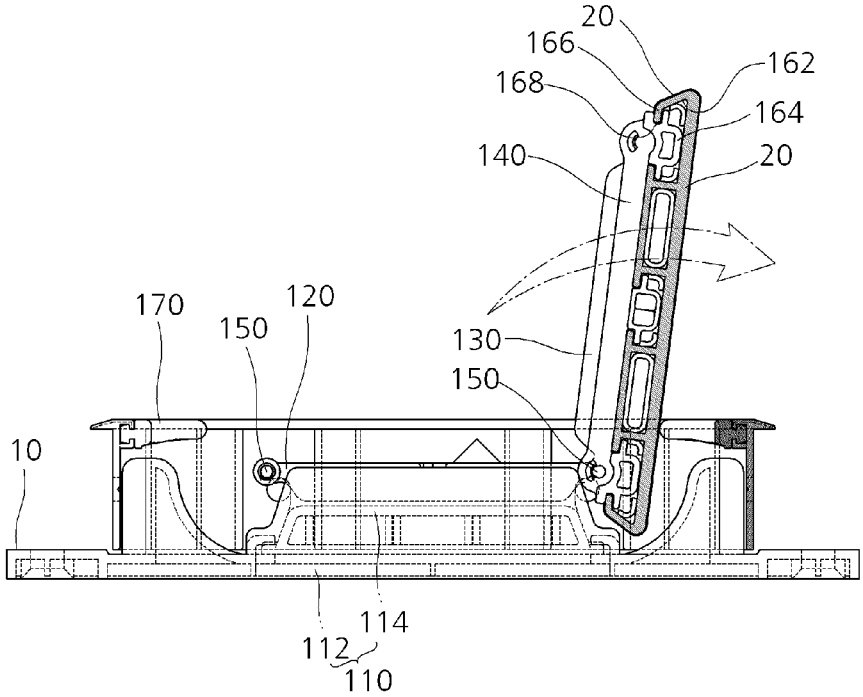
FIG. 10 is a sectional view of FIG. 8.

FIG. 8 is a perspective view of the bilateral rotation apparatus, which is open at the other side thereof, according to the embodiment of the present invention, FIG. 9 is a side view of FIG. 8, and FIG. 10 is a sectional view of FIG. 8.

Figure 11:
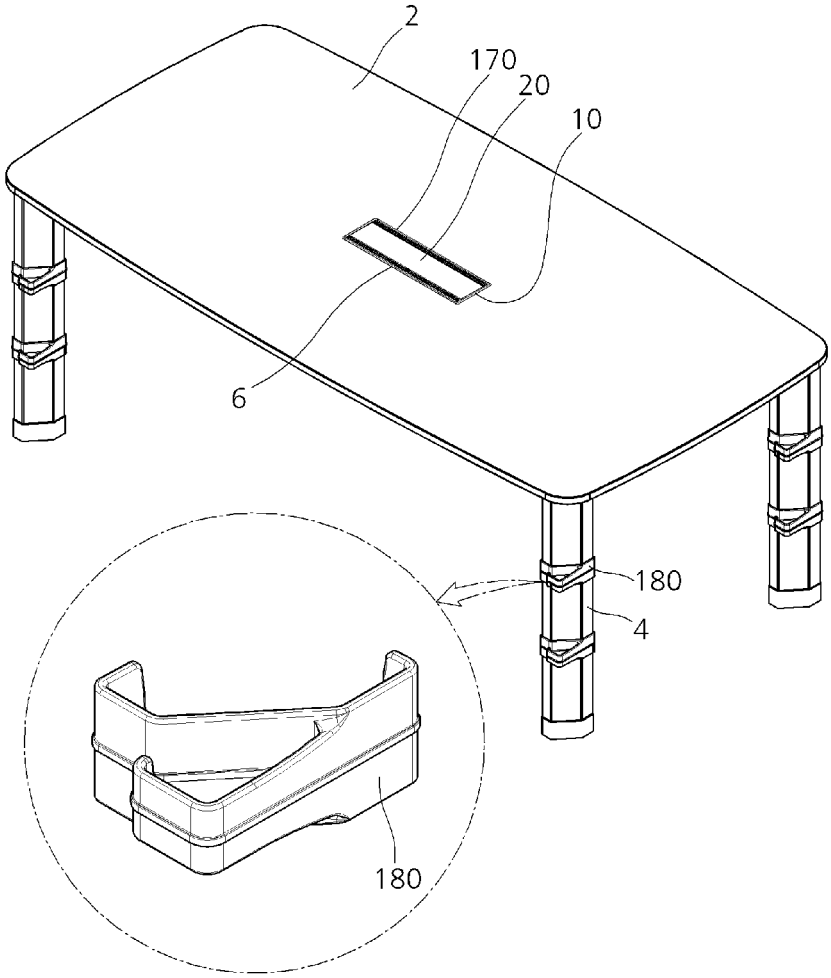
FIG. 11 is a perspective view of a holder provided to the furniture including the bilateral rotation apparatus according to the embodiment of the present invention.

FIG. 11 is a perspective view of a holder provided to the furniture including the bilateral rotation apparatus according to the embodiment of the present invention.

Figure 12:
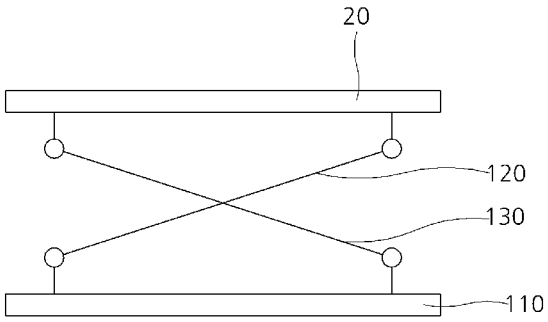
FIG. 12 is a schematic view of the bilateral rotation apparatus with a cover closed, according to the embodiment of the present invention.
Figure 13:
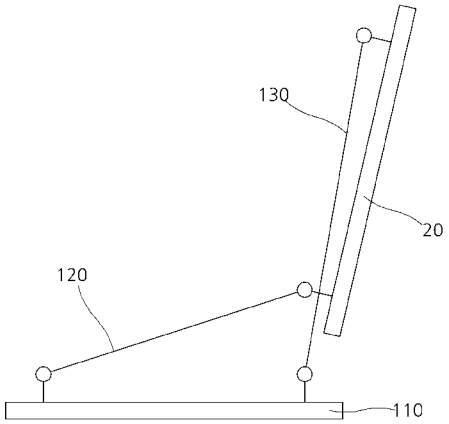
FIG. 13 is a link diagram of the bilateral rotation apparatus with the cover open in one direction according to the embodiment of the present invention.
Figure 14:
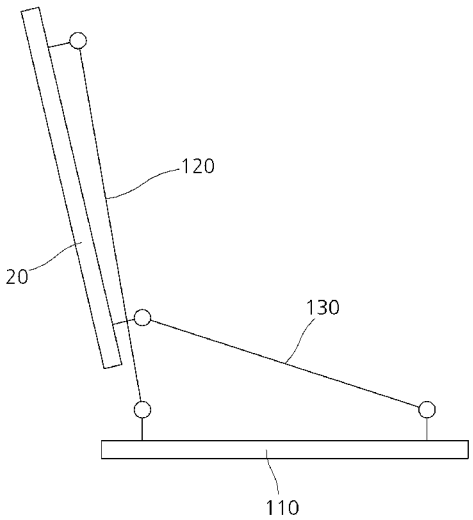
FIG. 14 is a link diagram of the bilateral rotation apparatus with the cover open in an opposite direction, according to the embodiment of the present invention.

FIG. 12 is a schematic view of the bilateral rotation apparatus with a cover closed, according to the embodiment of the present invention, FIG. 13 is a link diagram of the bilateral rotation apparatus with the cover open in one direction according to the embodiment of the present invention, and FIG. 14 is a link diagram of the bilateral rotation apparatus with the cover open in an opposite direction, according to the embodiment of the present invention.

Referring to FIGS. 1 and 2, furniture according to the present invention includes a panel 2 on which work is performed or an object is positioned, and legs 4 for supporting the panel 2.

The panel 2 may have various shapes and be formed of various materials, and the legs 2 extend downward from the panel 2 by various methods. Of course, the legs 4 may have various shapes and be formed of various materials.

In particular, the panel 6 is formed with an installation hole 6 through which upper and lower sides of the panel 2 communicate with each other. The installation hole 6 may be formed at any place in the panel 2.

In addition, a frame 10 is disposed in the installation hole 6. The frame 10 is inserted into and fixed to the installation hole 6. The frame 10 may be held in the panel 2 so as not to be released to a lower side of the installation hole 6. Then, the frame 10 may have a shape corresponding to a planar shape of the installation hole 10 and may be open at upper and lower sides thereof.

Bilateral rotation apparatuses 100 are placed at opposite sides of the frame 10. A cover 20 is connected to an upper side of each of the bilateral rotation apparatuses 100. Thus, the cover 20 is bilaterally rotated by the bilateral rotation apparatuses 100, and as the cover 20 is rotated independently in one direction or in an opposite direction, a raising position of the cover 20 may be adjusted upon opening the frame 10, whereby restriction on directionality of wiring operation of a cable (not shown) inserted into the frame 10 through the upper side of the panel 2 can be prevented.

Referring to FIGS. 3 and 4, the bilateral rotation apparatus 100 includes a support member 110, first connecting rods 120, second connecting rods 130, and connecting members 140.

The support member 110 is connected to a lower side of the frame 10 and supports the first connecting rods 120, the second connecting rods 130, the connecting members 140, and the cover 20.

Each of the first connecting rods 120 is hingedly connected to one side of the support member 110 in a longitudinal direction thereof. Accordingly, the first connecting rod 120 is rotated along a locus of an arc about a connection point between the first connecting rod 120 and the one side of the support member 110.

Each of the second connecting rods 130 is hingedly connected to the other side of the support member 110 in the longitudinal direction. Accordingly, the second connecting rod 120 is rotated along a locus of an arc about a connection point between the second connecting rod 130 and the other side of the support member 110.

A free end of each of the second connecting rods 130 is hingedly connected to one side of the corresponding connecting member 140, and a free end of the first connecting rod 120 is hingedly connected to the other side of the other connecting member 140.

Thus, the first connecting rods 120 and the second connecting rods 130 are disposed so as to intersect each other in an 'X' shape, with a distance between the ends thereof maintained by the connecting members 140.

Although one or more first connecting rods 120 may be provided, two first connecting rods 120 are illustrated for convenience.

Likewise, although one or more second connecting rod 120 may be provided, two second connecting rods 130 are illustrated for convenience.

The connecting members 140 are disposed on an upper side of the support member 110. One of the connecting members 140 is hingedly connected at one side thereof to the second connecting rods 130 and the other connecting member 140 is hingedly connected at the other side thereof to the first connecting rods 120 in the longitudinal direction so as to be rotated independently in one direction or in an opposite direction. The connecting members 140 are also connected to the cover 20.

Here, the first connecting rods 120 and the second connecting rods 130 may have various shapes, and may be formed of various materials.

The support member 110 includes a plate 112 and a support block 114.

The plate 112 is detachably coupled to lower opposite sides of the frame 10 in the longitudinal direction. In particular, the plate 112 is coupled to the frame 10 in various methods, for example, by bolts and nuts. Of course, the plate 112 may be detachably coupled to a lower side of the panel 2.

The plate 112 is formed at opposite inner sides thereof with contact protrusions 117 facing each other. A pair of contact protrusions 117 is formed on each plate 112 to set an installation place of the plate 112 while contacting opposite inner sides of the frame 10.

The contact protrusions 117 may be modified in various shapes.

The support block 114 is detachably coupled to the plate 112 and serves to directly hingedly connect the first connecting rods 120 to the second connecting rods 130.

Of course, the first connecting rods 120 and the second connecting rods 130 may be directly hingedly coupled to the plate 112.

In particular, the support block 114 may be detachably coupled to the plate 112 for maintenance and repair.

For example, the plate 112 is formed at the opposite sides thereof with insertion ribs 115 bent in opposite directions such that the support block 114 is slidably insert into the insertion ribs 115.

Accordingly, opposite edges of the plate 112 are slidably inserted into the corresponding insertion ribs 115.

The first connecting rods 120 and the second connecting rods 120 may be hingedly connected to the support block 114 and the connecting members 140 in various ways.

For example, hinge pins 150 are formed on the support block 114 and the connecting members 140 to be hingedly inserted into corresponding portions of the first connecting rods 120 and the second connecting rods 130.

Here, with the connecting members 140 placed parallel to the support member 110, the hinge pin 150 of the support block 114 for hingedly connecting one side of the first connecting rod 120 is coaxial with the hinge pin 150 of the connecting member 140 for hingedly connecting one side of the second connecting rod 130.

Likewise, with the connecting members 140 placed parallel to the support member 110, the hinge pin 150 of the connecting member 140 for hingedly connecting the other side of the first connecting rod 120 is coaxial with the hinge pin 150 of the support block 114 for hingedly connecting the other side of the second connecting rod 130.

With this structure, when the connecting members 140 is inclined upon rotation in one direction, the connecting member 140 is prevented from being rotated in another direction.

Of course, the connecting members 140 may be modified in various shapes.

The cover 20 may be connected to the connecting members 140 in various ways.

For example, the cover 20 is formed with insertion grooves 162 arranged in plural rows in the longitudinal direction.

Each of the connecting members 140 is formed with insertion bosses 164 to be inserted into the corresponding insertion grooves 162.

The insertion bosses 164 are press-fitted into the insertion grooves 162.

Each of the insertion grooves 162 is formed at one side thereof or at either side thereof with a guide rib 166, and each of the insertion bosses 164 is formed with a resilient guide groove 168 into which the guide rib 166 is resiliently inserted.

That is, as the insertion bosses 164 are inserted into the insertion grooves 162, the resilient guide grooves 168 are resiliently widened such that the guide ribs 166 are press-fitted into the resilient guide grooves 168, whereby the cover 20 can be firmly connected to the connecting members 140.

The cover 20 may have a smaller area than a planar area of an opened portion of the frame 10 such that wiring operation can be performed in a closed state of the cover 20. Thus, while the cover 20 blocks the frame 10, the wiring operation can be performed through an exposed space.

That is, when the cover 20 completely blocks the opened portion of the frame 10, there can be damage or safety accident upon standing a wire upright.

The frame 10 may include a flexible brush member 170 to prevent free movement of a cable in the exposed space and to prevent foreign matter from being introduced into the frame.

Here, the brush member 170 may be formed of various materials and have various shapes.

The brush member 170 may be integrally formed with the frame 10, or may be detachably attached thereto.

It is desirable to arrange a cable when the cable is provided from an upper side of the frame 10 to a lower side.

Thus, the leg 4 may include a detachable holder 180 for inserting and arranging the cable.

As shown in FIG. 11, one side of the holder 180 is resiliently widened to receive the leg 4. Then, the cable is inserted into a hole of the holder 180. Accordingly, the holder 180 holds the cable in a secured state, thereby enabling arrangement of the cable.

Operation of the bilateral rotation apparatus 100 according to the embodiment of the present invention will be described.

First, as shown in FIGS. 5 to 7, when a user rotates the cover 20 in the counterclockwise direction with respect to the frame 10 to secure a space for inserting a cable into the frame 10 in wiring operation, one of the connecting members 140 is rotated in the counterclockwise direction with respect to one side of the support member 110.

As a result, the cover 20 and the connecting member 140 are rotated in the counterclockwise direction to be erected.

Each of the first connecting rods 120 is connected at one end thereof to the hinge pin 150 of the support block 114 to be rotated in the counterclockwise direction, and the other side thereof is lifted together with the corresponding connecting member 140. Here, the second connecting rod 130 is parallel to the plate 112.

At this time, one of the connecting members 140 is connected at one side thereof to one side of each of the second connecting rods 130 to be fixed, and the other connecting member 140 is connected at the other side thereof to the other side of each of the first connecting rods 120 to be rotated in the counterclockwise direction with respect to the one side of the connecting member 140.

Here, the first connecting rods 120 and the second connecting rods 130 are alternately arranged, and the other side of each of the first connecting rods 120 and the one side of each of the second connecting rods 130 are connected to the corresponding connecting members 140, respectively, while maintaining an interval therebetween.

The hinge pin 150 to which the one side of each of the first connecting rods 120 and the support block 114 are hingedly connected is coaxial with one end of each of the second connecting rods 130 laying on the plate 112.

Thus, when the connecting member 140 and the cover 20 are rotated in the counterclockwise direction, the connecting member 140 and the cover 20 are prevented from rotating in the clockwise direction.

That is, when the connecting member 140 and the cover 20 are rotated in the counterclockwise direction, a user can rotate the cover 20 in the clockwise direction with respect to the frame 10 to open the cover 20 by rotating the connecting member 140 and the cover 20 in the clockwise direction to return the connecting member 140 and the cover 20 to original positions thereof to be parallel to the plate 112.

That is, as shown in FIGS. 8 to 10, the cover 20 and the connecting member 140 are rotated in the clockwise direction to be erected.

Each of the second connecting rods 130 is connected at the other side thereof to the hinge pin 150 of the support block 114 to be rotated in the counterclockwise direction, and one side thereof is lifted together with the corresponding connecting member 140. Here, the first connecting rods 120 are parallel to the plate 112.

At this time, one of the connecting members 140 is connected at the other side thereof to the other side of each of the first connecting rods 120 to be fixed, and the other connecting member 140 is connected at one side thereof to the one side of each of the second connecting rods 130 to be rotated in the clockwise direction with respect to the other side thereof.

Here, the first connecting rods 120 and the second connecting rods 130 are alternately arranged, and the other side of each of the first connecting rods 120 and the one side of each of the second connecting rods 130 are connected to the corresponding connecting members 140 while maintaining an interval therebetween.

The hinge pin 150 to which the one side of each of the second connecting rods 130 and the support block 114 are hingedly connected is coaxial with one end of each of the first connecting rod 130 laying on the plate 112.

Thus, when the connecting member 140 and the cover 20 are rotated in the clockwise direction, the connecting member 140 and the cover 20 are prevented from rotating in the counterclockwise direction.

That is, when the connecting member 140 and the cover 20 are rotated in the clockwise direction, a user can rotate the cover 20 in the counterclockwise direction with respect to the frame 10 to open the cover 20 by rotating the connecting member 140 and the cover 20 in the counterclockwise direction to return the connecting member 140 and the cover 20 to original positions thereof to be parallel to the plate 112.

FIG. 12 illustrates a link connection state of the bidirectional rotation apparatus 100 with the cover 20 closed, FIG. 13 illustrates a link connection state of the bidirectional rotation apparatus 100 with the cover 20 open in one direction, and FIG. 14 illustrates a link connection state of the bidirectional rotation apparatus 100 with the cover 20 open in an opposite direction. Reference numerals are the same as those described above.

As described above, the bilateral rotation apparatus according to the present invention is provided to a panel of a table to allow a wiring cap for wiring operation to be open independently in one direction or in an opposite direction, thereby eliminating restriction on a wiring direction or a direction of approaching the table in use. The furniture including the same may also eliminate restriction on a wiring direction or a direction of approaching the furniture in use.

Although some embodiments have been described herein, it should be understood that these embodiments are given by way of illustration only, and that various modifications, variations, and alterations can be made without departing from the spirit and scope of the present invention. The scope of the present invention should be limited only by the accompanying claims and equivalents thereof.

What is claimed is:

1. A bilateral rotation apparatus comprising:

a support member;

a first connecting rod hingedly connected to one side of the support member in a longitudinal direction of the support member to pivot relative to the one side of the support member;

a second connecting rod hingedly connected to an opposite side of the support member in the longitudinal direction of the support member to pivot relative to the opposite side of the support member; and a plurality of connecting members disposed on an upper side of the support member, a first connecting member of the plurality of connecting members being hingedly connected at one side thereof to the second connecting rod and a second connecting member of the plurality of connecting members being hingedly connected at the other side thereof to the first connecting rod in the longitudinal direction of the support member so as to be rotated independently in one direction or in an opposite direction;

wherein the support member includes a plate that is provided at opposite sides thereof with a plurality of insertion ribs bent towards each other, and a support block slidably inserted between the plurality of insertion ribs and hingedly connected to one end of the first connecting rod by using a first hinge pin and hingedly connected to the opposite end of the second connecting rod by using a second hinge pin.

2. Furniture comprising:

an installation hole formed in a panel;

a frame inserted into the installation hole and open at upper and lower sides thereof;

a plurality of bilateral rotation apparatuses placed at opposite edges of the frame;

a cover connected at lower opposite sides thereof to each of the plurality of the bilateral rotation apparatuses and rotated independently in one direction or in an opposite direction to prevent restriction on a directionality of a wiring operation;

a support member connected to a lower side of the frame;

a first connecting rod hingedly connected to one side of the support member in a longitudinal direction of the support member to pivot relative to the one side of the support member;

a second connecting rod hingedly connected to an opposite side of the support member in the longitudinal direction of the support member to pivot relative to the opposite side of the support member;

a plurality of connecting members disposed on an upper side of the support member, a first connecting member of the plurality of connecting members being hingedly connected at one side thereof to the second connecting rod and a second connecting member of the plurality of connecting members being hingedly connected at the other side thereof to the first connecting rod in the longitudinal direction of the support member so as to be rotated independently in one direction or in an opposite direction, the plurality of connecting members being connected to the cover; and an insertion groove formed on a bottom surface of the cover; and a protrusion formed on a top surface of the cover;

wherein, when the plurality of connecting members are covered with the cover, the protrusion is inserted into the insertion groove.

3. The furniture according to claim 2, wherein the insertion groove has a guide rib at one side or either side thereof, and wherein the protrusion has a guide groove that is made of resilient materials into which the guide rib is inserted.

4. The furniture according to claim 2, wherein the cover has a smaller area than a planar area of an opened portion of the frame such that the wiring operation includes a plurality of wires that are arranged in a closed state of the cover, and the frame comprises a flexible brush member to.

5. The furniture according to claim 2, wherein the panel comprises a plurality of legs extending therefrom, each of the plurality of legs comprising a detachable holder for inserting and arranging a wired cable in the leg.

* * * * *